US008279136B2

(12) United States Patent
Li et al.

(10) Patent No.: US 8,279,136 B2
(45) Date of Patent: Oct. 2, 2012

(54) ANTENNA MODULE AND WIRELESS COMMUNICATION DEVICE USING THE SAME

(75) Inventors: Zhan Li, Shenzhen (CN); Ye Xiong, Shenzhen (CN); Hao-Sheng Zhang, Shenzhen (CN); Wei-Dong Hao, Shenzhen (CN); Guang Peng, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 483 days.

(21) Appl. No.: 12/634,805

(22) Filed: Dec. 10, 2009

(65) Prior Publication Data

US 2011/0050510 A1 Mar. 3, 2011

(30) Foreign Application Priority Data

Aug. 27, 2009 (CN) ..... 2009 1 0306149

(51) Int. Cl.
*H01Q 1/36* (2006.01)

(52) U.S. Cl. ..... 343/895; 343/702; 977/950

(58) Field of Classification Search ..... 343/700 MS, 343/702, 895; 977/950
See application file for complete search history.

(56) References Cited

U.S. PATENT DOCUMENTS

| | | | | |
|---|---|---|---|---|
| 5,909,196 | A * | 6/1999 | O'Neill, Jr. | 343/895 |
| 6,642,893 | B1 * | 11/2003 | Hebron et al. | 343/702 |
| 2005/0116867 | A1 * | 6/2005 | Park et al. | 343/725 |

* cited by examiner

*Primary Examiner* — Dieu H Duong
(74) *Attorney, Agent, or Firm* — Altis Law Group, Inc.

(57) ABSTRACT

An antenna module includes a frequency modulation radiator and a T-coil radiator electronically connecting to the frequency modulation radiator. The T-coil radiator and the frequency modulation radiator are made of conductive nano material. The present further discloses a wireless communication device using the antenna module.

6 Claims, 3 Drawing Sheets

ANTENNA MODULE AND WIRELESS COMMUNICATION DEVICE USING THE SAME

BACKGROUND

1. Technical Field

The present disclosure relates to antenna modules, and particularly, to an antenna module used in a wireless communication device.

2. Description of Related Art

Wireless communication devices, such as mobile phones, personal digital assistants (PDAs) and laptop computers are widely used. Most of these wireless communication devices have a function of receiving frequency modulation (FM) signals.

Wireless communication devices typically have no FM antennas to receive FM signals. The conventional wireless communication devices are usually equipped with external accessories (e.g. earphones) that serve as FM antennas to receive FM signals. The earphones have to be inserted/connected to the wireless communication device to facilitate as the FM signal receiving function. Thus, it is necessary to carry the earphone with the wireless communication device for FM function.

In addition, the wireless communication devices should have hearing aids function to aid hearing impaired people. The conventional wireless communication devices are usually equipped with a T-coil integrated with an earphone. The T-coil can convert an acoustical signal to an electromagnetic wave. A hearing aid can receive the electromagnetic wave and convert the electromagnetic wave to an acoustical signal. Thus, the aid hearing impaired people can hear sound of the earphone. However, if the T-coil is made of metal, the extended length of the T-coil would reach 22 km to 250 km. Thus, the wireless communication devices should have larger chamber and volume.

Therefore, there is a room for improvement within the art.

BRIEF DESCRIPTION OF THE DRAWINGS

Many aspects of an antenna module and wireless communication device using the antenna module can be better understood with reference to the following drawings. The components in the drawings are not necessarily to scale, the emphasis instead being placed upon clearly illustrating the antenna module and wireless communication device using the antenna module. Moreover, in the drawings, like reference numerals designate corresponding parts throughout the several views.

DETAILED DESCRIPTION OF THE EMBODIMENTS

The present antenna module is suitable for wireless communication devices, such as mobile phones and so on.

Figure 1:
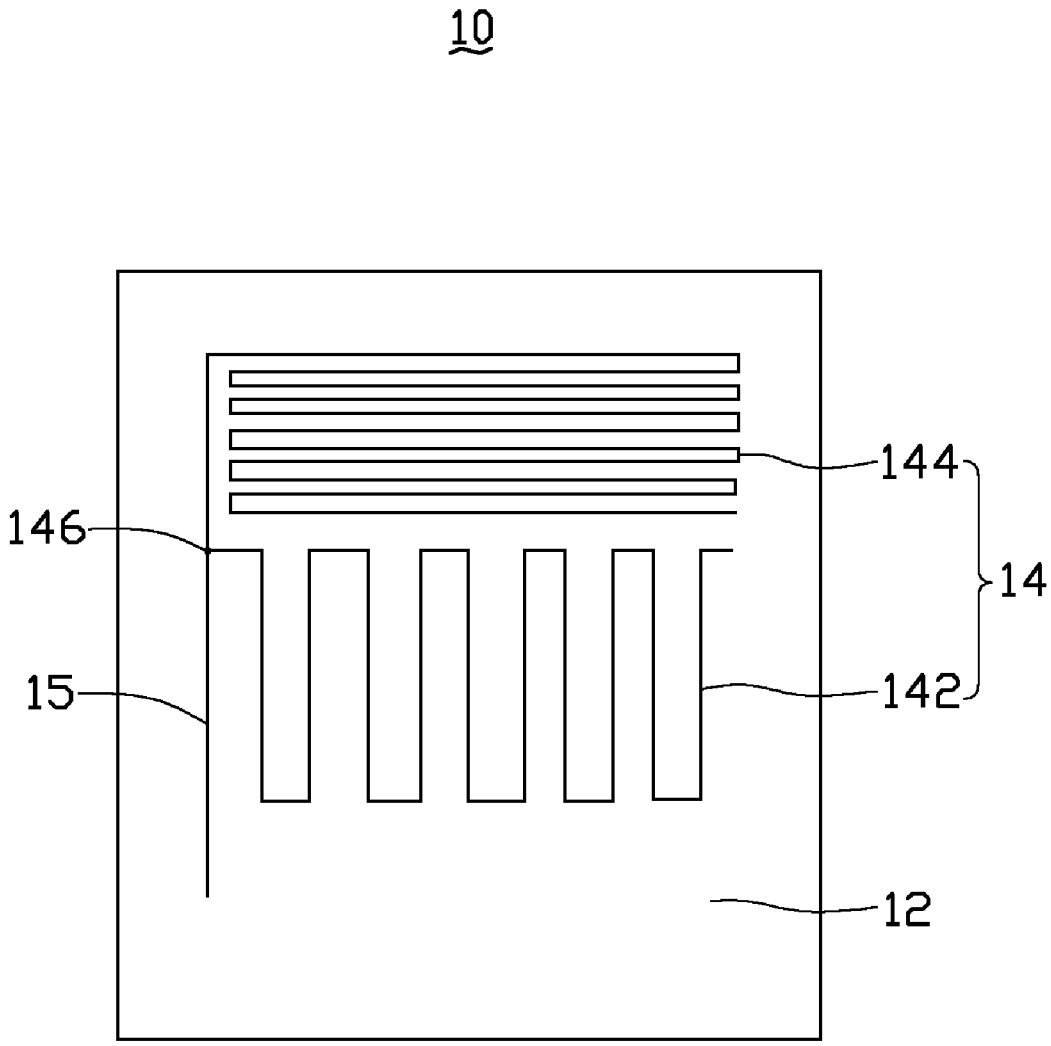
FIG. 1 is a front view of an antenna module, according to a first exemplary embodiment.

FIG. 1 shows a first exemplary antenna module 10 including a carrier 12 and a radiator 14 formed on the carrier 12.

The carrier 12 can be made of an insulating resin material selected from a group consisting of polycarbonate (PC) and acrylonitrile-butadiene-styrene (ABS). The radiator 14 can be made of conductive nano material. The radiator 14 includes a frequency modulation (FM) radiator 142 and a T-coil radiator 144 connecting to the FM radiator 142. A connecting point 146 is formed at a connection between the FM radiator 142 and the T-coil radiator 144. The FM radiator 142 and the T-coil radiator 144 are deposited on the carrier 12 in the shape of a square-wave by a method of laser direct structuring (LDS). The extended length of the FM radiator 142 is about 0.4 m to 1 m, and its working frequency is about 87.5 MHz to 108 MHz. The extended length of the T-coil radiator 144 is about 22 km to 250 km, and its working frequency is about 300 Hz to 3.4 KHz. A feed line 15 connects the connecting point 146 to a radio frequency (RF) processing chip (not shown). A free end of the FM radiator 142 and the T-coil radiator 144 connects to ground.

Figure 2:
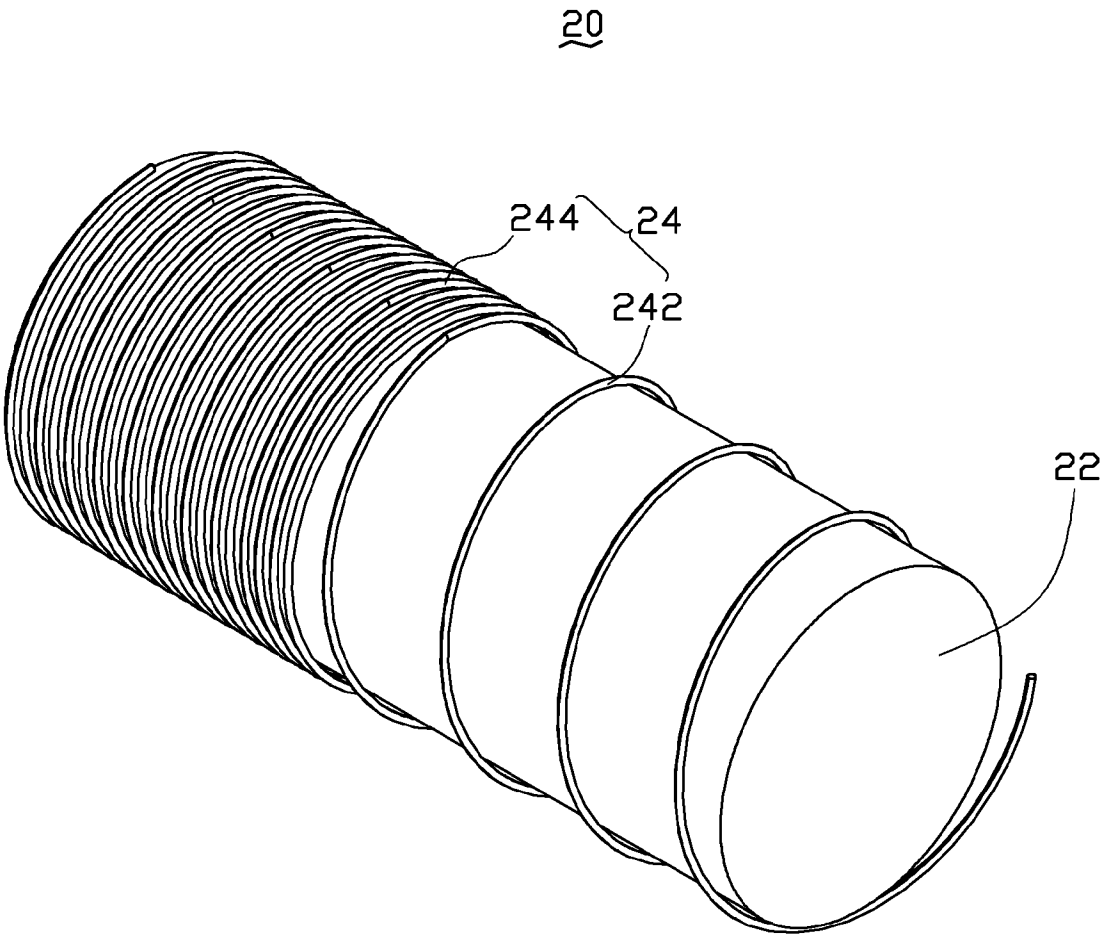
FIG. 2 is an isometric view of an antenna module, according to a second exemplary embodiment.

FIG. 2 shows a second exemplary antenna module 20 including a carrier 22 and a radiator 24.

The carrier 22 is a cylinder made of plastic. To improve performance, the carrier 22 can be made of a material with high permittivity or high permeability, such as ceramic.

The radiator 24 can be made of conductive nano material. The radiator 24 includes a FM radiator 242 and a T-coil radiator 244 connecting to the FM radiator 242. The radiator 24 is coiled around the carrier 22. A winding density of the FM radiator 242 is lower than the T-coil radiator 244. A working frequency of the FM radiator 242 is about 87.5 MHz to 108 MHz, and a working frequency of the T-coil radiator 244 is about 300 Hz to 3.4 KHz. A free end of the FM radiator 142 and the T-coil radiator 144 connects to a feed line (not shown) for electronically connecting to a radio frequency (RF) processing chip (not shown).

Figure 3:
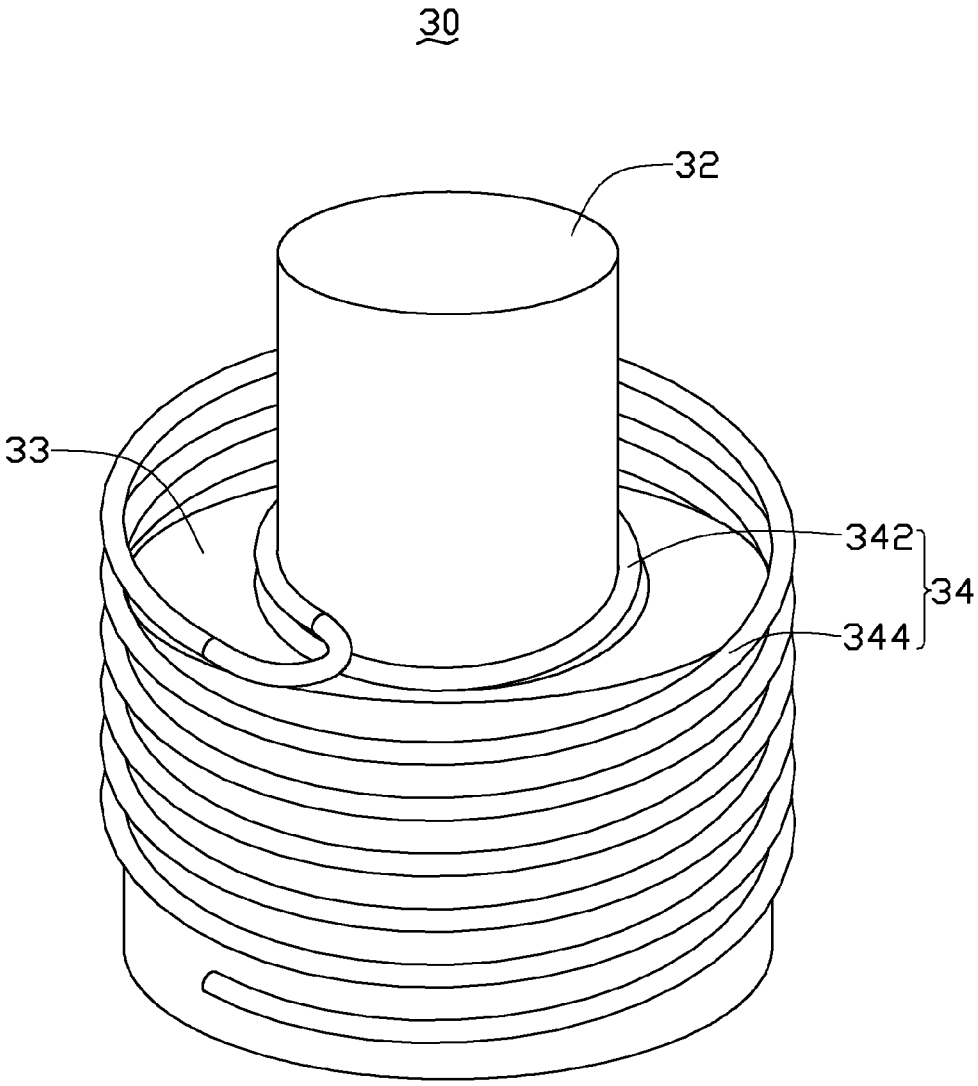
FIG. 3 is an isometric view of an antenna module, according to a third exemplary embodiment.

FIG. 3 shows a third exemplary antenna module 30 including a first carrier 32, a second carrier 33, and a radiator 34.

The first carrier 32 is a cylinder made of plastic. The second carrier 33 is cylindrical, made of plastic. The first carrier 32 is axially disposed on the second carrier 33. A diameter of the first carrier 32 is smaller than the second carrier 33, thereby forming a stepped cylinder. To improve performance, the first carrier 32 and the second carrier 33 can be made of a material with high permittivity or high permeability, such as ceramic.

The radiator 34 can be made of conductive nano material. The radiator 34 includes a T-coil radiator 342 and a FM radiator 344. The T-coil radiator 342 coils around the first carrier 32. The second carrier 33 coils around the T-coil radiator 342. The FM radiator 344 coils around the second carrier 33. A working frequency of the FM radiator 344 is about 87.5 MHz to 108 MHz, and a working frequency of the T-coil radiator 342 is about 300 Hz to 3.4 KHz. A winding density of the FM radiator 344 is lower than the T-coil radiator 342. A free end of the FM radiator 344 and the T-coil radiator 342 connects to a feed line (not shown) for electronically connecting to a radio frequency (RF) processing chip (not shown).

The antenna module 10 includes a T-coil radiator and a FM radiator made of conductive nano material. Thus, the total size of the antenna module 10 can be minimized. The wireless communication devices can receive FM radio signals without support of additional earphones or other accessories. Simultaneously, the wireless communication devices can further facilitate as hearing aids for the hearing impaired.

It is to be understood that the carrier 22 and the first carrier 32 can be omitted for reduce volume of the antenna module 10.

It is to be understood that the shape of the FM radiator 142 and the T-coil radiator 144 are not limited in square-wave, also can be saw-shaped or undulating-shaped.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna module, comprising:

a carrier being a cylinder;

a frequency modulation radiator coiling around the carrier;

a T-coil radiator coiling around the carrier and electronically connecting to the frequency modulation radiator;

wherein a winding density of the frequency modulation radiator is lower than the T-coil radiator, the T-coil radiator and the frequency modulation radiator are made of conductive nano material.

2. The antenna module as claimed in claim 1, wherein the carrier is a stepped cylinder and includes a first carrier and a second carrier, a diameter of the first carrier is smaller than the second carrier, the T-coil radiator coils around the first carrier, and the frequency modulation radiator coils around the second carrier.

3. The antenna module as claimed in claim 2, wherein the first carrier, and the second carrier are made of ceramic, a working frequency of the frequency modulation radiator is about 87.5 MHz to 108 MHz, and a working frequency of the T-coil radiator is about 300 Hz to 3.4 KHz.

4. A wireless communication device, comprising:

an antenna module integrated in the wireless communication device, the antenna module comprising:

a carrier being a cylinder;

a frequency modulation radiator coiling around the carrier;

a T-coil radiator coiling around the carrier and electronically connecting to the frequency modulation radiator;

wherein a winding density of the frequency modulation radiator is lower than the T-coil radiator, the T-coil radiator and the frequency modulation radiator are made of conductive nano material, the frequency modulation radiator allows the wireless communication device to receives signal without an additional earphone.

5. The wireless communication device as claimed in claim 4, wherein the carrier is a stepped cylinder and includes a first carrier and a second carrier, a diameter of the first carrier is smaller than the second carrier, the T-coil radiator coils around the first carrier, and the frequency modulation radiator coils around the second carrier.

6. The wireless communication device as claimed in claim 5, wherein the first carrier, and the second carrier are made of ceramic, a working frequency of the frequency modulation radiator is about 87.5 MHz to 108 MHz, and a working frequency of the T-coil radiator is about 300 Hz to 3.4 KHz.

* * * * *